US010184306B2

(12) United States Patent
Hagar

(10) Patent No.: US 10,184,306 B2
(45) Date of Patent: Jan. 22, 2019

(54) DETECTING AND REMEDIATING DOWNHOLE EXCESSIVE PRESSURE CONDITION

(71) Applicant: HALLIBURTON ENERGY SERVICES, INC., Houston, TX (US)

(72) Inventor: Everett Philip Hagar, Devon (CA)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 196 days.

(21) Appl. No.: 15/318,305

(22) PCT Filed: Jul. 28, 2014

(86) PCT No.: PCT/US2014/048483
§ 371 (c)(1),
(2) Date: Dec. 12, 2016

(87) PCT Pub. No.: WO2016/018231
PCT Pub. Date: Feb. 4, 2016

(65) Prior Publication Data

US 2017/0130543 A1 May 11, 2017

(51) Int. Cl.
*E21B 7/06* (2006.01)
*E21B 21/08* (2006.01)
(Continued)

(52) U.S. Cl.
CPC ..... *E21B 21/08* (2013.01); *E21B 7/062* (2013.01); *E21B 17/046* (2013.01); *E21B 17/1057* (2013.01); *E21B 47/06* (2013.01)

(58) Field of Classification Search
CPC ..... E21B 7/06; E21B 7/062
See application file for complete search history.

(56) References Cited

U.S. PATENT DOCUMENTS 5,220,963 A * 6/1993 Patton ..... E21B 7/04 175/24
6,230,824 B1 5/2001 Peterman et al.
(Continued)

FOREIGN PATENT DOCUMENTS

CA 2564116 A1 1/2001
EP 0720685 B1 3/2002
(Continued)

OTHER PUBLICATIONS

Search Results for "pack off" in the Schlumberger Oilfield Glossary, pp. 1-2, http://glossary.oilfield.slb.com/en/Terms.aspx?LookIn=term%20name&filter=pack+off.
(Continued)

*Primary Examiner* — Giovanna C. Wright
(74) *Attorney, Agent, or Firm* — Polsinelli PC

(57) ABSTRACT

A rotary subterranean drill capable of detecting an excessive downhole pressure condition and automatically remediating the causal condition of the detected excessive pressure condition. A pressure detector coupled to a drill string of the rotary subterranean drill can sense an excessive downhole pressure condition that exceeds a predetermined value. When an excessive downhole pressure condition is sensed at the pressure detector drag members are automatically disengaged from the borehole, thereby permitting rotation of the anchorable exterior portion within the borehole.

21 Claims, 9 Drawing Sheets

(51) Int. Cl.

| | |
|---|---|
| ***E21B 17/046*** | (2006.01) |
| ***E21B 17/10*** | (2006.01) |
| ***E21B 47/06*** | (2012.01) |

(56) References Cited

U.S. PATENT DOCUMENTS

| | | | | |
|---|---|---|---|---|
| 6,401,838 | B1 | 6/2002 | Rezmer-Cooper | |
| 8,615,363 | B2 | 12/2013 | Aamodt et al. | |
| 2002/0185314 | A1 | 12/2002 | Cargill et al. | |
| 2008/0110674 | A1* | 5/2008 | Jones | E21B 7/062 175/25 |
| 2012/0059521 | A1 | 3/2012 | Iversen et al. | |
| 2013/0048380 | A1 | 2/2013 | Rasmus et al. | |

FOREIGN PATENT DOCUMENTS

| | | | |
|---|---|---|---|
| EP | 1308599 | A2 | 5/2003 |
| EP | 1556579 | B1 | 10/2006 |
| EP | 2404031 | A1 | 1/2012 |
| WO | 2011043768 | A1 | 4/2011 |
| WO | 2013082498 | A2 | 6/2013 |
| WO | 2013089810 | A1 | 6/2013 |

OTHER PUBLICATIONS

International Search Report and Written Opinion; PCT Application No. PCT/US2014/048486; dated May 7, 2015.
International Preliminary Report on Patentability; PCT Application No. PCT/US2014/048486; dated Sep. 30, 2016.
Entry of the Article 34 amendment as filed; PCT Application No. PCT/US2014/048486.

* cited by examiner

DETECTING AND REMEDIATING DOWNHOLE EXCESSIVE PRESSURE CONDITION

CROSS-REFERENCE TO RELATED APPLICATIONS

This application is a national stage entry of PCT/US2014/048483 filed Jul. 28, 2014, said application is expressly incorporated herein in its entirety.

FIELD

The present disclosure relates generally to drilling systems, and in particular to drilling systems for oil and gas exploration and production operations.

BACKGROUND

Oil and gas operations involve drilling deep within subterranean formations to access hydrocarbon reserves. Directional drilling has been employed with steerable systems in order to reach desired sites for hydrocarbon retrieval.

One type of directional drilling involves rotary steerable drilling systems. Rotary steerable drilling allows a drill string to rotate continuously while steering the drill string to a desired target location in a subterranean formation. Rotary steerable drilling systems are generally positioned at a lower end of the drill string and typically include a rotating drill shaft or mandrel, a housing that rotatably supports the drill shaft, and additional components within the housing that orient the toolface direction of the drill bit at the end of the drill shaft relative the housing. In some rotary steerable drilling systems, an anti-rotation device is provided to engage the borehole wall and prevent rotation of the housing.

Drilling fluid, or "mud," can be employed during drilling to transport cuttings or cavings around the drill string to the surface. In certain conditions, cuttings, cavings and/or drill fluid can become entrapped around the drill string, thus impeding or blocking circulation of the fluid, commonly referred to as a "pack-off." In such cases pressure can suddenly rise excessively and the drill string or tools associated with the drill string can potentially become stuck and immobile.

BRIEF DESCRIPTION OF THE DRAWINGS

Implementations of the present technology will now be described, by way of example only, with reference to the attached figures, wherein.

DETAILED DESCRIPTION

Figure 1:
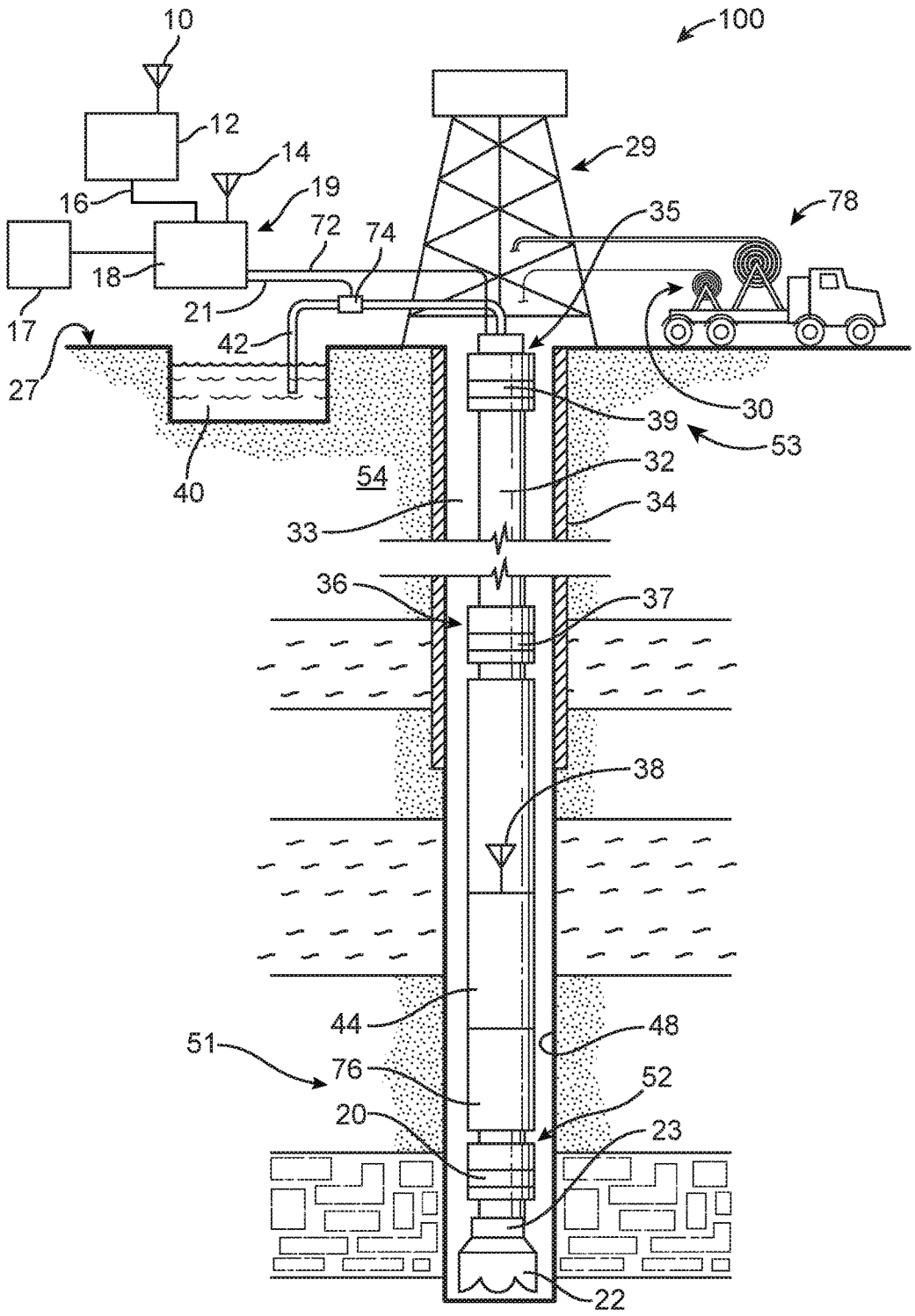
FIG. 1 is a diagram illustrating an embodiment of a drilling rig for drilling a wellbore with the drilling system configured in accordance with the principles of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, and the like orientations shall mean positions relative to the orientation of the wellbore or tool. Additionally, the illustrated embodiments are depicted so that the orientation is such that the right-hand side is downhole compared to the left-hand side.

Several definitions that apply throughout this disclosure will now be presented. The term "coupled" is defined as connected, whether directly or indirectly through intervening components, and is not necessarily limited to physical connections. The connection can be such that the objects are permanently connected or releasably connected. The term "communicatively coupled" is defined as connected, either directly or indirectly through intervening components, and the connections are not necessarily limited to physical connections, but are connections that accommodate the transfer of data between the so-described components. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other thing that "substantially" modifies, such that the component need not be exact. For example, substantially cylindrical means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

The term "radial" and/or "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Disclosed herein is a drill system and method for detecting an excessive downhole pressure condition and automatically remediating the causal condition of the detected excessive pressure condition. During drilling operations, drilling fluid is pumped from the surface around the drill bit to clean cuttings and other drilled formation components. The drilling fluid then circulates to the surface around the annulus of the drill string. Situations arise where fluid and other material from the formation can become entrapped in the annulus. This can occur for example, due to poor hole quality, portions of the formation caving in, or cuttings other components blocking the flow of the drilling fluid. This can be referred to herein as a "pack-off." As a result, an excessive downhole pressure condition can occur, such as a sharp increase in pressure. Further, as a result of such pack-off, tools along the drill string can become stuck and immobile.

In particular, tools having an anchorable exterior portion, for example the housing of a rotary steerable drilling device, can be susceptible to the occurrence of a pack-off, which can then slow drilling and increase costs. The housing of rotary steerable drilling devices have anti-rotation devices for deploying drag members that engage the borehole wall and resist rotation of the housing. Cuttings, drilling fluid, cavings and other formation materials can become stuck around the anti-rotation device as well as the substantially non-rotating housing thereby forming a pack-off and immobilizing the drilling device. Moreover, it is possible also that other portions of the drill string or rotary steerable drill which have deployable tools can be susceptible to pack-off, for example stabilizers of the rotary steerable drill.

In order to detect the presence of a pack-off, or other occurrence which leads to an excessive pressure condition, a pressure detector can be coupled to the drill string at a location at or below the housing and at or above the drill bit. The pressure detector permits sensing the occurrence of an excessive downhole pressure condition, including the magnitude of pressure and/or the rate of pressure change. The pressure detector can be communicatively coupled to the drag members of the anti-rotation device, for example via a control unit. For instance a control unit can be coupled to both the pressure detector and the anti-rotation device. In order to remediate a detected excessive pressure condition, an automated response can be implemented. For example, when an excessive pressure condition is sensed, a drag release can automatically disengage the drag members from the borehole wall.

Depending on the conditions, the release of the drag members can potentially have an immediate impact on the pressure condition. For example, by withdrawal of the drag members, additional space in the annulus is immediately made and can lead to a decrease in pressure or flow of drilling fluid or other material. Moreover, the release of the drag members can permit rotation of the housing of the rotary steerable drill. The rotation can have the effect of breaking up the material causing the pack-off. As an additional remedy, the housing can be caused to rotate by a clutch system or a locking assembly which imparts torque from the shaft or drill string to the housing. The additional rotational force to the housing can aid in breaking up of any blocked material.

The various embodiments and examples illustrating the disclosure herein are further described below.

Drill String and Rotary Steering Device

The present disclosure is described in relation to a rotary subterranean drill 100 that is depicted schematically in FIG. 1. A borehole 48 is shown that has been drilled into the formation 54 from the ground's surface 27 using a drill bit 22. The drill string 32 is elongate and extends lengthwise from an upper end 53 down the borehole 48 to a lower distal end 51. The drill bit 22 is located at the bottom, or lower distal end 51 of the drill string 32 and the bit 22 and drill string 32 are being advanced into the formation 54 by the drilling rig 29. The drilling rig 29 can be supported directly on land as shown or on an intermediate platform if at sea. For illustrative purposes, the top portion of the well bore includes casing 34 that is typically at least partially comprised of cement and which defines and stabilizes the wellbore after being drilled.

As shown in FIG. 1, the drill string 32 supports several components along its length. A sensor sub-unit 52 is shown for detecting conditions near the drill bit 22, conditions which can include such properties as formation fluid density, temperature and pressure, and azimuthal orientation of the drill bit 22 or string 32. In the case of directional drilling, measurement while drilling (MWD)/logging while drilling (LWD) procedures are supported both structurally and communicatively. The instance of directional drilling is illustrated in FIG. 1. The lower end portion of the drill string 32 can include a drill collar proximate the drilling bit 22 and a rotary steerable drilling device 20. The drill bit 22 may take the form of a roller cone bit or fixed cutter bit or any other type of bit known in the art. The sensor sub-unit 52 is located in or proximate to the rotary steerable drilling device 20 and advantageously detects the azimuthal orientation of the rotary steerable drilling device 20. Other sensor sub-units 35, 36 are shown within the cased portion of the well which can be enabled to sense nearby characteristics and conditions of the drill string, formation fluid, casing and surrounding formation. Regardless of which conditions or characteristics are sensed, data indicative of those conditions and characteristics is either recorded downhole, for instance at the control unit 44 for later download, or communicated to the surface either by wire using repeaters 37,39 up to surface wire 72, or wirelessly or otherwise. If wirelessly, the downhole transceiver (antenna) 38 can be utilized to send data to a local control unit 18, via topside transceiver (antenna) 14. There the data may be either processed or further transmitted along to a remote control unit 12 via wire 16 or wirelessly via antennae 14 and 10.

Utilization in, and interaction with coiled tubing 78 and wireline 30 procedures is schematically indicated in FIG. 1 as being contemplated and within the context of this disclosure.

The possibility of an additional mode of communication is contemplated using drilling mud 40 that is pumped via conduit 42 to a downhole mud motor 76. The drilling mud is circulated down through the drill string 32 and up the annulus 33 around the drill string 32 to cool the drill bit 22 and remove cuttings from the borehole 48. For purposes of communication, resistance to the incoming flow of mud can be modulated downhole to send backpressure pulses up to the surface for detection at sensor 74, and from which representative data is sent along communication channel 21 (wired or wirelessly) to one or more control units 18, 12 for recordation and/or processing.

The sensor sub-unit 52 is located along the drill string 32 above the drill bit 22. The sensor sub-unit 36 is shown in FIG. 1 positioned above the mud motor 76 that rotates the drill bit 22. Additional sensor sub-units 35, 36 can be included as desired in the drill string 32. The sub-unit 52 positioned below the motor 76 communicates with the sub-unit 36 in order to relay information to the surface 27.

A pressure detector (or sensor) 23 can be positioned at the drill bit 22 (at-the-bit), or just above the drill bit 22 toward the distal end of the rotary drilling device 20. The pressure detector 23 detects or senses the pressure around the drilling device 20, such as pressure in the annulus 33. The pressure detector 23 can be positioned for example, at or near the drill bit 22, proximate the anchorable exterior portion, or housing, of the drilling device 20, or at or near an anti-rotation device or stabilizers provided on the drilling device 20. Although in the illustrative example the pressure detector 23 is associated with the drilling device 20, in other examples it can be provided elsewhere along the drill string 32, for example, other tools along the string 32, in particular tools having an anchorable exterior portion, for example a substantially non-rotating housing. The pressure detector can be communicatively coupled to a control unit integrated in the drilling device 20, and/or with control unit 44, and/or with control units 18, 12 or 17.

The pressure detector 23 can be any type of detector which is able to sense or detect the pressure or changes to pressure of the fluid, either gas, liquid or solid material in and around the drill string. For example, the pressure detector can be or include a transducer which generates a signal, electrical or otherwise, as a function of the pressure. Accordingly, any pressure sensitive device capable of providing a signal representative of the sensed pressure can be employed. The signal can be transmitted to any of the aforementioned control units. The pressure detector 23 can sense the magnitude of pressure and/or the rate of change in pressure.

A surface installation 19 is shown that sends and receives data to and from the well. The surface installation 19 can exemplarily include a local control unit 18 that can optionally communicate with one or more remote control units 12, 17 by wire 16 or wirelessly using transceivers 10, 14.

The rotary subterranean drill 100 can include a rotary drilling system comprising a rotary drilling device 20 incorporated as a portion of the drill string 32. An exemplary rotary steerable drilling device 20 is schematically shown in FIG. 1 and can also be referred to as a drilling direction control device or system. As shown, the rotary drilling device 20 is positioned on the drill string 32 with drill bit 22. However, one of skill in the art will recognize that the positioning of the rotary steerable drilling device 20 on the drill string 22 and relative to other components on the drill string 22 may be modified while remaining within the scope of the present disclosure.

Figure 2:
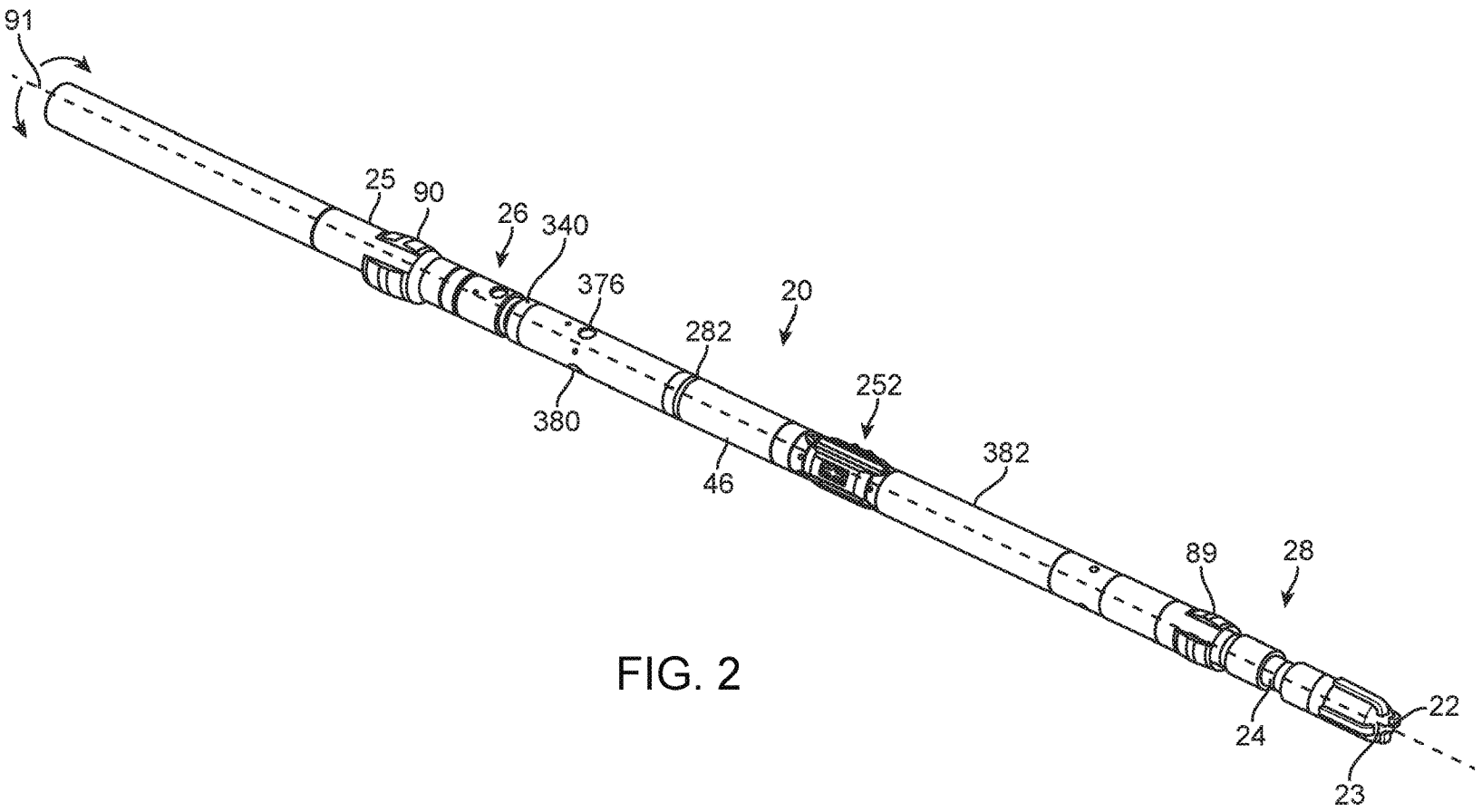
FIG. 2 is a diagram illustrating one embodiment of a rotary steerable drilling device according to the present disclosure.

Referring now to FIG. 2, the rotary steerable drilling device 20 is comprised of a rotatable drilling shaft 24 that is connectable or attachable to a rotary drill bit 22 and to a rotary drilling string 25 during the drilling operation. More particularly, the drilling shaft 24 has a proximal end 26 closest to the earth's surface and a distal end 28 deepest in the well, furthest from the earth's surface. The proximal end 26 is drivingly connectable or attachable with the rotary drilling string 25 such that rotation of the drilling string 25 from the surface results in a corresponding rotation of the drilling shaft 24. The proximal end 26 of the drilling shaft 24 may be permanently or removably attached, connected or otherwise affixed with the drilling string 25 in any manner and by any structure, mechanism, device or method permitting the rotation of the drilling shaft 24 upon the rotation of the drilling string 25. In this regard, a drive connection connects the drilling shaft 24 with the drilling string 25. As indicated, the drive connection may be comprised of any structure, mechanism or device for drivingly connecting the drilling shaft 24 and the drilling string 25 so that rotation of the drilling string 25 results in a corresponding rotation of the drilling shaft 24.

The distal end 28 of the drilling shaft 24 is drivingly connectable or attachable with the rotary drill bit 22 such that rotation of the drilling shaft 24 by the drilling string 25 results in a corresponding rotation of the drill bit 22. The distal end 28 of the drilling shaft 24 can be permanently or removably coupled with the drill bit 22 in any manner and by any structure, mechanism, device or method permitting the rotation of the drill bit 22 upon the rotation of the drilling shaft 24. Additionally, a threaded connection may also be utilized for coupling.

The drilling shaft 24 may be comprised of one or more elements or portions connected, attached or otherwise affixed together in any suitable manner providing a unitary drilling shaft 24 between the proximal and distal ends 26, 28. In some examples, any connections provided between the elements or portions of the drilling shaft 24 are relatively rigid such that the drilling shaft 24 does not include any flexible joints or articulations therein. The drilling shaft 24 may be comprised of a single, unitary or integral element extending between the proximal and distal ends 26, 28. Further, the drilling shaft 24 is tubular or hollow to permit drilling fluid (mud) to flow therethrough in a relatively unrestricted and unimpeded manner.

The drilling shaft 24 can be comprised of any material suitable for and compatible with rotary drilling. Additionally, the drilling shaft 24 can be comprised of high strength stainless steel and is sometimes referred to as a mandrel.

The rotary steerable drilling device 20, as a component of a rotary drilling system, comprises a housing 46 having an anchorable exterior portion that rotatably supports a length of the drilling shaft 24 for rotation therein upon rotation of the attached drilling string 25. As the housing 46 can be a component of the rotary steerable drilling device 20, and the drilling device 20 can be incorporated as a portion of the drill string 32, the housing 46 is therefore also considered an incorporable portion of the drill string 32. The housing 46 may support, and extend along any length of the drilling shaft 24. However, in the illustrated example, the housing 46 supports substantially the entire length of the drilling shaft 24 and extends substantially between the proximal and distal ends 26, 28 of the drilling shaft 24. The drilling shaft 24 and the housing 46 can be each substantially cylindrical shaped and have a longitudinal centerline 91.

The housing 46 may be comprised of one or more tubular or hollow elements, sections or components permanently or removably connected, attached or otherwise affixed together to provide a unitary or integral housing 46 permitting the drilling shaft 24 to extend therethrough.

The rotary steerable drilling device 20 can optionally be further comprised of a near bit stabilizer 89, preferably located adjacent to the distal end of the housing 46. There can also be a far bit stabilizer 90 on the drill string 25 just above the proximal end 28 of the drilling device 20. The far bit stabilizer 90 may also be located as part of the drilling device, just above the anti-rotation device at the proximal end of the drilling device 20. The far and near bit stabilizers 90, 89 can be comprised of any type of stabilizer and may be either adjustable or non-adjustable. In particular they can be made up of pads deployable from a retracted position to an extended position. The pads can have a biasing device such as a spring, or be inflatable, or a combination of spring and inflatable pads. To the extent such pads resiliently contact the borehole wall and resist rotation, these can be considered drag members.

The distal end comprises a distal radial bearing which comprises a fulcrum bearing, also referred to as a focal bearing, or some other bearing which facilitates the pivoting of the drilling shaft 24 at the distal radial bearing location upon the controlled deflection of the drilling shaft 24 by the rotary steerable drilling device 20 to produce a bending or curvature of the drilling shaft 24.

The rotary steerable drilling device 20 can further comprise at least one proximal radial bearing which can be contained within the housing 46 for rotatably supporting the drilling shaft 24 radially at a proximal radial bearing location defined thereby.

The deflection assembly within the rotary steerable drilling device 20 provides for the controlled deflection of the drilling shaft 24 resulting in a bend or curvature of the drilling shaft 24, as described further below, in order to provide the desired deflection angle of the attached drill bit 22. The orientation of the deflection of the drilling shaft 24 can be altered in order to change the orientation of the drill bit 22 or toolface, while the magnitude of the deflection of the drilling shaft 24 can also be altered to vary the magnitude of the deflection of the drill bit 22 or the bit tilt relative to the housing 46. The deflection assembly can include for example eccentric rings, having an outer eccentric ring and an inner eccentric ring which when rotated relative one another can deflect the shaft 24, and when rotated together affect the azimuthal toolface direction of the drill bit 22.

The rotary steerable drilling device 20 comprises a distal seal or sealing assembly and a proximal seal or sealing assembly 282. The distal seal can be radially positioned and provide a rotary seal between the housing 46 and the drilling shaft 24 at, adjacent or in proximity to the distal end of the housing 46. In this way, the housing 46 can be maintained as a compartment or container for the contents located therein. The compartment may also be a closed compartment when it is sealed.

The rotary steerable drilling device 20 can include one or more thrust bearings at thrust bearing locations. Thrust bearings can be positioned at any location along the length of the drilling shaft 24 that rotatably and radially supports the drilling shaft 24 within the housing 46, but resists longitudinal movement of the drilling shaft 24 relative to the housing 46.

The rotary steerable drilling device 20 optionally can have a housing orientation sensor apparatus 52 as shown in FIG. 1 for sensing the orientation of the housing 46 within the wellbore. The housing orientation sensor apparatus 52 can contain an At-Bit-Inclination (ABI) insert associated with the housing 46. Additionally, the rotary steerable drilling device 20 can have a drilling string orientation sensor apparatus 376. Sensors which can be employed to determine orientation include for example magnetometers and accelerometers.

A local control unit 380 can be contained within the drilling device 20. The local control unit 380 can process data, receive and transmit and process signals to sensors, tools, anti-rotation devices, stabilizers, and perform alone, in part, or connected with other processors or control units the functions of the rotary steerable drilling device 20. The control unit 380 can additionally be a hydraulic or electrical circuit, or a logic controller. Control units according to the present disclosure, are discussed further below (see FIG. 8).

The rotary steerable drilling device 20 can have an anti-rotation device 252 to resist rotation of the housing 46 (further discussed with respect FIG. 3 below). Additionally, the drilling device 20 can optionally have a releasable drilling-shaft-to-housing locking assembly 382 (see FIG. 5) which can be used to selectively lock the drilling shaft 24 and housing 46 together. As discussed hereinabove and below, in some situations downhole, it is desirable that the shaft 24 not be able rotate relative to the housing 46. One such instance can be if the drilling device 20 gets stuck downhole, for reasons disclosed herein, for example due to a pack-off; in that case it may be desirable to attempt to rotate the housing 46 to dislodge the drilling device 20 in the wellbore. In order to accomplish this, a locking assembly 382 can be provided to selectively engage (lock) and release the housing 46 with the drilling shaft 24, such that the rotation of the drilling shaft 24 in turn causes of the housing 46 together therewith. Alternatively, a clutch system 340 can be employed which transfers the rotational energy from the shaft 24 or drill string 25 to the housing 46 thereby causing rotation of the housing 46. Clutch systems known in the art can be employed. For example, a friction clutch can be employed to transmit rotational energy to the housing 46.

Further, in order that information or data may be communicated along the drilling string 25 from or to downhole locations, the rotary steerable drilling device 20 can include a drilling string communication system as earlier described.

Anti-rotation Device

Referring to FIG. 2 and as explained above, during drilling, the rotary steerable drilling device 20 can be anchored in the wellbore against rotation which would otherwise be imparted by the rotating drilling shaft 24. As previously noted, the housing 46 of the drilling device 20 has an anchorable exterior portion. In fact any tool having an outer surface or outer portion of a housing for anchoring against rotation can be considered to have an anchorable exterior portion. To effect such anchoring, there is provided one or more anti-rotation devices 252 associated with the rotary steerable drilling device 20 for resisting rotation within the wellbore. Any type of anti-rotation device 252 or any mechanism, structure, device or method capable of restraining or inhibiting the tendency of the housing 46 to rotate upon rotary drilling can be used.

Figure 3:
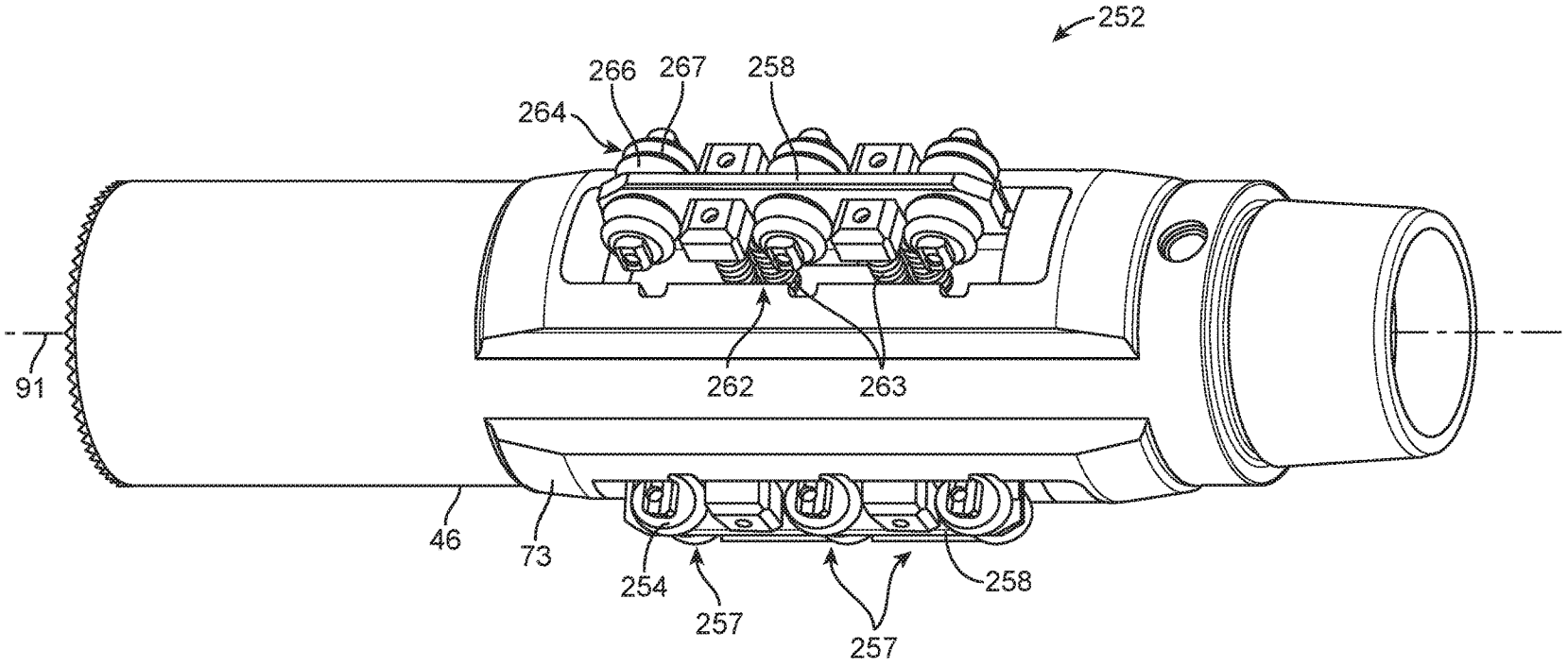
FIG. 3 is a diagram illustrating one embodiment of an anti-rotation device according to the present disclosure.

Referring now to FIG. 3, the anti-rotation device 252 can be associated with any portion of the housing 46 including proximal, central and distal housing sections. In other words, the anti-rotation device 252 can be located at any location or position along the length of the housing 46 between its proximal and distal ends. In the illustrated embodiment, the device 252 is associated with the proximal housing section, upward, toward the ground's surface. Finally, the device 252 may be associated with the housing 46 in any manner permitting the functioning of the device 252 to inhibit or restrain rotation of the housing 46. The anti-rotation device 252 can be positioned at an exterior surface of the housing 46.

In some examples, the anti-rotation device 252 can have one or more sets 257 of radially deployable drag members 254 (the six drag members 254 associated with each frame 258 can be considered one set), extensible with respect to the longitudinal centerline 91 of the housing 46. In other examples, three sets 257 of drag members 254 can be spaced peripherally (circumferentially) at equidistant points about the housing 46, for example each at 120 degrees from each other. The anti-rotation device 252 may also feature a plurality of sets 257 of drag members 254 spaced about the housing 46, set at equidistant points, for example, 2, 3, 4, 6, 7, 8, or more sets 257 of drag members 254. In some examples, either alone, or among a plurality of sets 257 of drag members 254, two sets of drag members can be spaced 180 degrees from on another peripherally around the housing.

Further, although in the illustrated example of FIG. 3 there is shown three pairs of drag members for each set 257, any number of drag members can be employed. For example, 1, 2, 3, 4, 5, 6, 7, 8, 9, 10 or more drag members can be employed for each set. The number of drag members can vary depending on the formation type, well conditions, as well as other considerations.

As shown in FIG. 3, the drag members 254 can be wheels or rollers and resemble round "pizza cutters" that extend at least partially outside the rotary steerable drilling device 20 and project into the formation surrounding the borehole when deployed. The drag members 254 are aligned for rotation down the wellbore, allowing the rotary steerable drilling device 20 to progress downhole during drilling. Each drag member 254 is oriented such that it is capable of rotating about its axis of rotation in response to a force exerted tangentially on the drag member 254 substantially in a direction parallel to the longitudinal centerline 91 of the housing 46. For instance, as a longitudinal force is exerted through the drill string 25 to the drilling shaft 24 in order to progress drilling, the drag member 254 rolls about its axis to facilitate the drilling device's 20 movement through the wellbore in either a downhole or uphole direction.

The drag members 254 resiliently engage the wall of the borehole to slow or inhibit turning of the housing 46 with the drilling shaft 24 while drilling. The shaft 24 contained within the housing 46 rotates in the clockwise direction, thus imposing a tendency in the housing 46 to also rotate. Accordingly, drag members 254 can have any shape or configuration permitting them to roll or move longitudinally through the wellbore, while also restraining the housing 46 against rotation within the wellbore. Accordingly, the housing 46 can be referred to as a non-rotating housing, wherein it is understood that the housing is substantially non-rotating, having for example one or two full rotations per hour.

Therefore, each drag member 254 has a peripheral surface 264 about its circumference permitting it to roll or move longitudinally within the wellbore and resist rotation. The periphery of each of the plurality of drag members 254 can be shaped to penetrate borehole-surrounding formation material. In particular, the peripheral surface 264 is differently shaped on each side presenting a resistive side-face 266 and a slip side-face 267. In particular, resistive side-face 266 is radiused with sufficient concavity that during clockwise torque or rotation of the housing 46, the drag member 254 penetrates into the formation and resists housing 46 rotation. Slip side-face 267 presents a beveled surface or ramp that permits rotation of the housing 46 in the counter-clockwise direction, albeit, with a certain amount of drag associated with the slippage. Therefore, rather than cutting into the formation during a counter-clockwise rotation of housing 46, slip side-face 267 can scrape or slip along the wellbore surface, permitting rotation.

As depicted in FIG. 3, the drag members 254 can be attached or mounted to frames 258 that act as carriage assemblies that can be mounted, connected or affixed at the outer surface of the housing 46 in any suitable manner. In some examples, the plurality of frames 258 are circumferentially and equidistantly spaced about the housing 46, and can be located to extend from within platforms 73. A biasing mechanism or device can be provided made up of, for example, a spring 263 that acts directly or indirectly between the housing 46 and the carriage assembly 258 or the drag members 254. Alternatively, or additionally, the biasing mechanism can be inflatable pads, which inflate to deploy the drag members 254 against a borehole wall.

The drag members 254 can be deployed radially outwardly from the housing in several ways. For example, as shown in FIG. 3, a biasing member 262 in the form of the illustrated spring 263 resiliently deploys the drag members 254 radially outwardly from the housing 46. In such example, due to the natural bias of the spring, the drag members 254 remain extended outwardly from the housing at all times. Accordingly, when placed in a borehole the drag members 254 engage the borehole and the spring 263 compresses and contracts depending on the size of the borehole. Additionally, due to the bias of the spring, the drag members press against and penetrate into the borehole wall. In other examples, the drag members 254 can have drag member release which radially retracts the drag members 254 from engagement with the borehole wall. Accordingly, the drag members 254 can have a retracted and extended position, thus being deployed when in the extended position. For example, reciprocating ramps can be provided beneath the springs 263, which can be moved back and forth raising and lowering the springs thereby extending and retracting the drag members 254.

Figure 4:
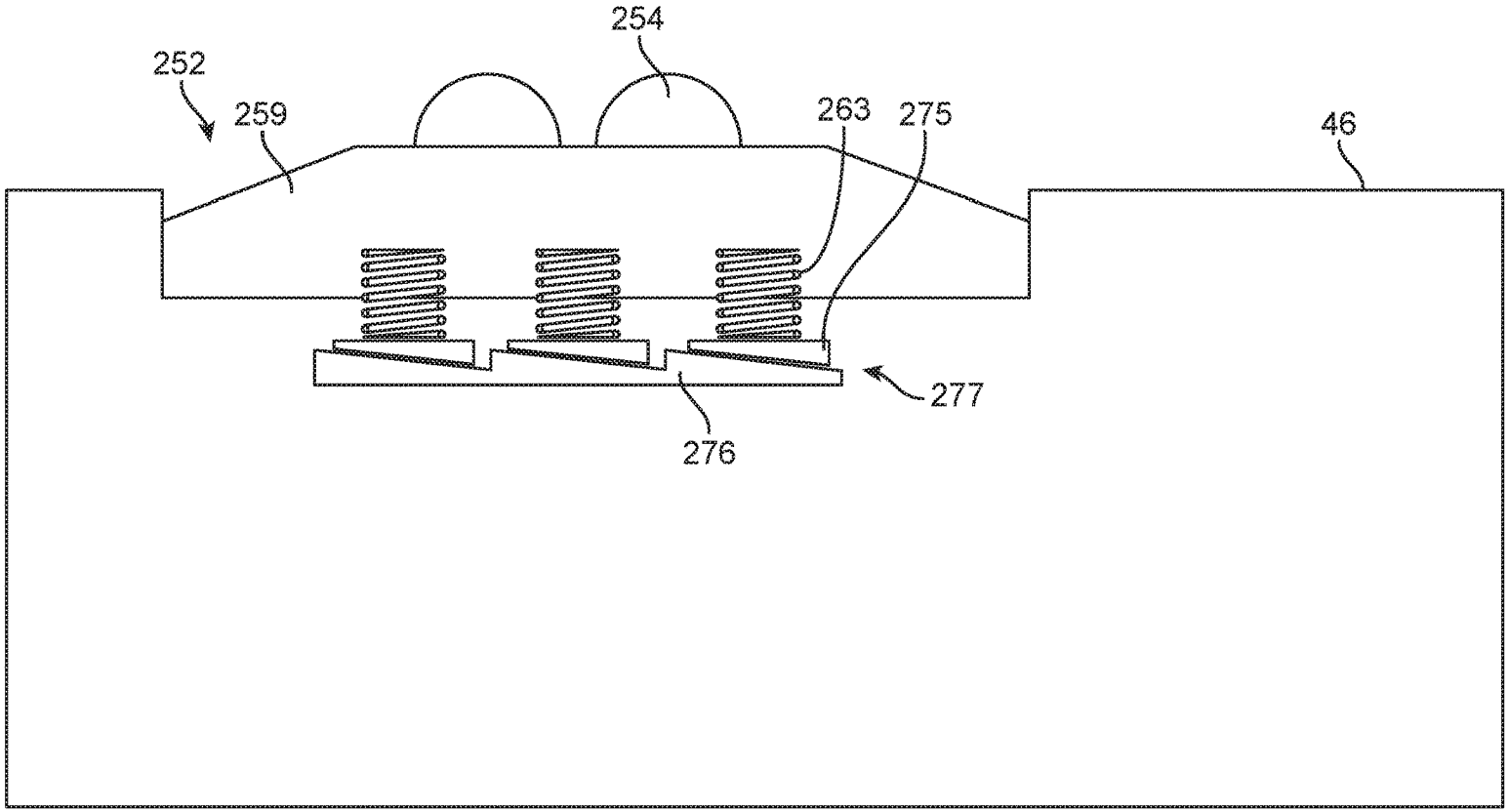
FIG. 4 is a diagram illustrating one embodiment of an exemplary drag release according to the present disclosure.

One example for deploying and releasing the drag members 254 is shown in FIG. 4. As illustrated the anti-rotation device 252 includes drag members 254, springs 263, and a drag release 277 for disengaging the drag members 254 from the borehole wall. The drag release 277 includes two complementary ramp surfaces for extending the drag members 254. For example, anti-rotation device 252 can include top ramp 275 and base ramp 276 that together constitute a base for the biasing springs 262. During drilling operations of the rotary steerable drill, the drag members 254 are ordinarily deployed and engage the borehole wall to reduce rotation of the housing 46. However upon detection of an excessive pressure condition, the drag release is engaged. In such instance, the base ramp 276 is moved proximally (to the left in FIG. 4). As the peak (thick) portions of each ramp move away from one another, the top ramp 275 is moved downward (radially inward). The drag members 254 are consequently withdrawn and disengaged from the borehole wall. A control unit communicatively can be coupled to the pressure detector 23 as well as the anti-rotation device 252 and drag release 277, thus communicatively coupling the drag release 277 and pressure detector. Accordingly, when an excessive pressure condition is sensed, the control unit can transmit a signal to actuate and engage the drag release 277 thereby causing disengagement of the drag members 254 from the borehole wall. In this way, the drag release, upon detection of an excessive pressure condition, can automatically disengage the drag members 254 from the borehole wall 49.

After release, the drag release 277 can be reset, thus deploying the drag members 254, by moving the base ramp 276 moves distally (to the right in FIG. 4). As the peak (thick) portions of each ramp move toward and oppose one another, the top ramp 275 is moved upward (radially outward). As a result, the drag members 254 are deployed extending outward from the housing 46.

Alternatively, the complementary ramps 275, 276 reposition (raise and lower) a restraining carriage assembly 259 relative to the housing 46. Accordingly, the drag members 254 are raised along with the restraining carriage assembly 259. In other examples, the top ramp 275 can be the one that moves, or both ramps 275, 276 can move relative to one another to extend the drag members 254.

In other examples, the drag release can comprise hydraulic actuators which can be provided beneath the drag members 254 or springs 263, or as part of drag members 254, to provide pressure and deploy to extend the drag members 254. Rather than springs 263, or in addition to springs 263, inflatable pads may be employed which upon inflating extend drag members 254 to a deployed position. The inflatable pads can be filled with pressurized fluid to engage drag members 254 against the borehole wall. The platforms 73 may also be made to raise and deploy the drag members 254 against a borehole wall.

Accordingly, deployment and release of the drag members 254 can be carried out in a multitude of ways. A deployed position can be considered any position where the drag members are extended outside of the housing 46 to a degree where contact with a borehole wall occurs when placed in a borehole, thereby providing anti-rotational drag.

Figure 4A:
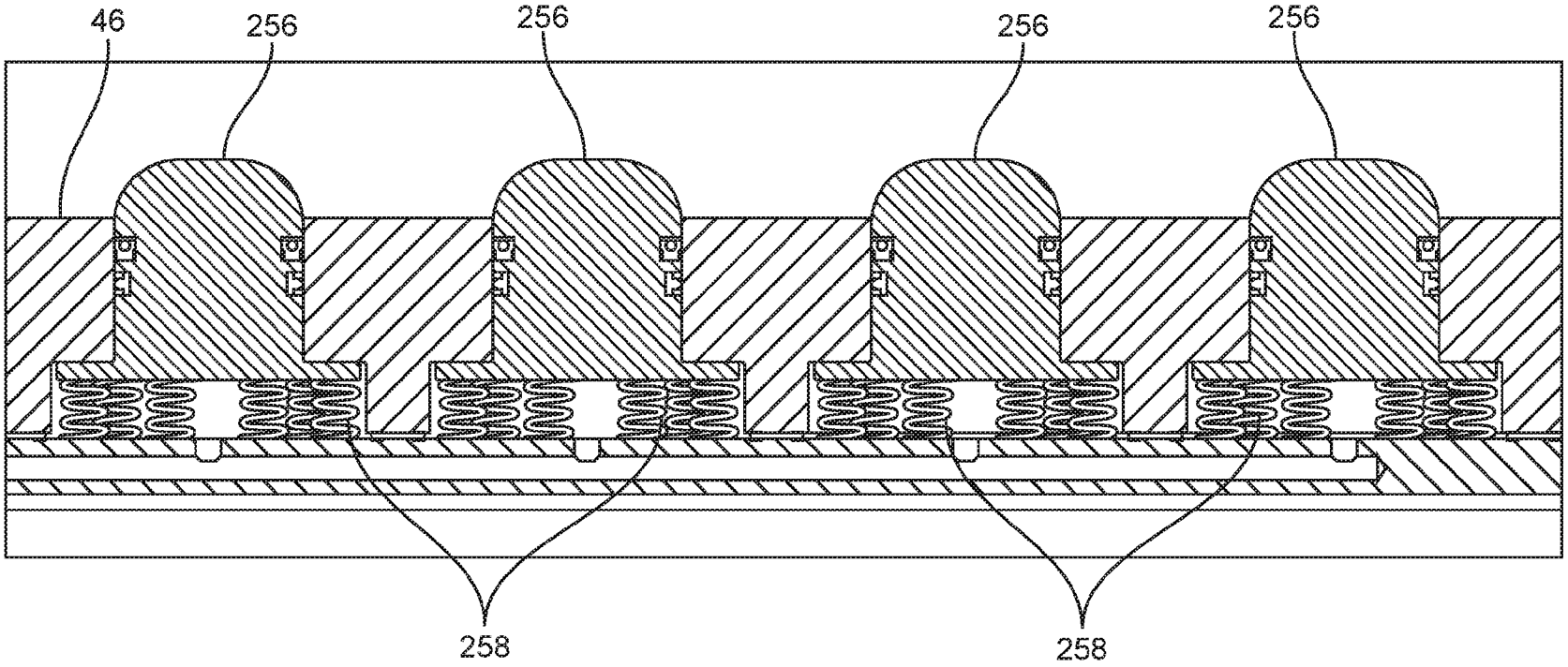
FIG. 4A is a diagram illustrating one embodiment of drag members of an anti-rotation device according to the present disclosure.

Further examples are shown in FIG. 4A, where there is illustrated drag members which are a plurality of retractable pistons 256, having springs 258. The pistons 256 when deployed engage the borehole wall. The springs 258 can be compressed in order to retract the pistons 256 from the borehole wall. In other examples, the pistons 256 can be pads or inflatable pads. In further examples, the pistons 256 can be deployed and retracted by fluid under pressure, including hydraulically. Accordingly, the manner in which the drag members are deployed and retracted is not particularly limited.

Figure 5:
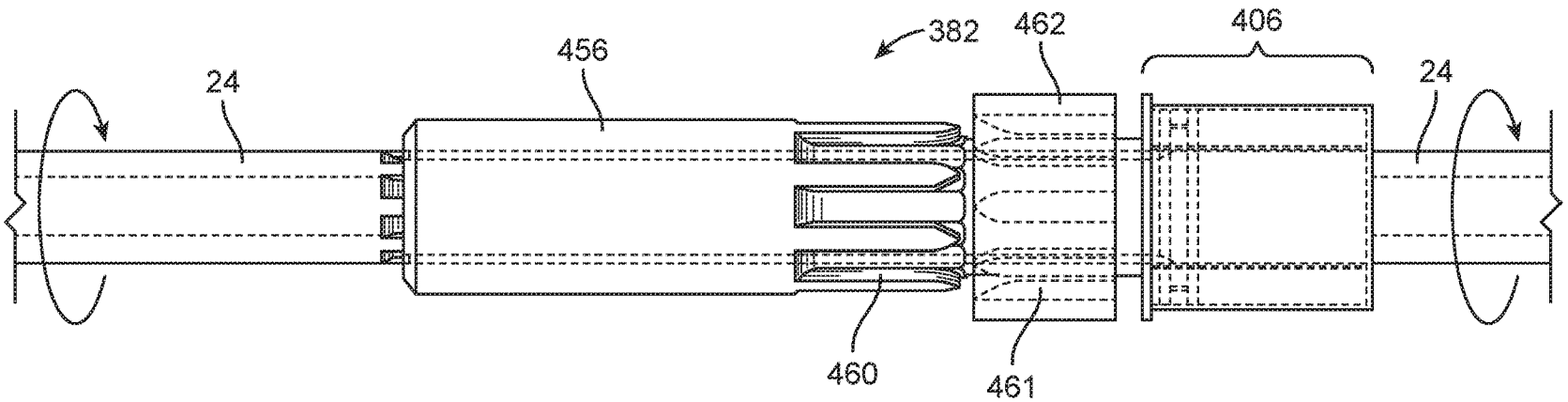
FIG. 5 is a diagram illustrating one embodiment of locking assembly according to the present disclosure.

Referring now to FIG. 5, there is illustrated one embodiment of a housing locking assembly 382. Accordingly, as shown is shaft 24 which is rotated by the drilling string 25 (shown in FIG. 1). A locking sleeve 456 is shown integrated with shaft 25 having male splines 460. Accordingly, with rotation of the shaft 25, the locking sleeve 456 turns as well. Complementary to the locking sleeve 456 is a locking ring 462 having female splines 461. The locking ring 462 can be integrated with the housing 46 (housing 46 shown in FIGS. 2-4, and 6). The locking ring 462 is longitudinally movable to engage the sleeve 456 and so that the male and female splines 460, 461 are brought into reciprocal engagement. Accordingly, when engaged, the rotation of the shaft and locking sleeve 456 in turn causes the same rotation in the locking ring 462, and by virtue of its integrated connection, the housing 46 is also caused to rotate. A powered abutment 406 can actuate to longitudinally move locking ring 462 into engagement with the locking sleeve 456. The locking sleeve 456 may also be made to move longitudinally in addition to or alternative to the movement of locking ring 462 for engagement thereof.

Although, one example of the locking assembly 382 is shown in FIG. 5, the locking assembly 382 can made up of any structure or apparatus which is capable of engaging the drilling shaft 24 with the housing 46 so that they rotate together.

Detecting and Remediating a Downhole Pressure Condition

As described previously, cuttings by the drill, drilling fluid, formation fluid, cavings, or other material can occasionally become entrapped and blocked around a portion of the drill string, causing a portion of the drill string to become stuck and immobile, and commonly referred to as a pack-off. One indicator of the occurrence of a pack-off is an excessive downhole pressure condition, such as a sharp increase in pressure. Typically, downhole conditions are such that there are inherently high temperatures or pressures are present, depending on the formation as well as depth and position. Such pressure can be considered as the normal pressure or steady state pressure of the formation in the absence of the pack-off or other interference. Accordingly, the presence of a pack-off can be indicated by a marked increase of pressure over the steady state pressure, or reference pressure. Moreover, the drilling fluid (mud) 40 can be pumped at particular pressures, and this can also be used as a reference pressure. Accordingly, testing or experience can predict what the steady state pressure or reference pressure can be. This steady state pressure or reference pressure can be predetermined and stored in a surface or downhole control unit, or modified or input from an operator at the surface.

The occurrence of a pack-off results in a sharp or marked increase in pressure over the reference pressure, and can be referred to as over-pressure. The magnitude at which the pressure condition becomes excessive can be set at a predetermined value. Further, the rate at which the pressure increases excessively can be predetermined value and indicative of an excessive pressure condition. Accordingly, when this predetermined value is met or exceeded it is indicative of an excessive pressure condition, and thus indicative of a pack-off or other excessive pressure initiating condition. A pressure detector, such as an at-the-bit pressure detector 23 can be employed to sense the existence of an excessive pressure condition.

In one example herein, the excessive pressure increase can occur around the drill, as well as around the anchorable exterior portion, namely the housing 46. In such case the excessive pressure would be present in the annulus, the area between the housing 46 and the borehole. Further, excessive pressure can occur at or near the far or near bit stabilizers. Accordingly, one or more pressure detectors can be placed anywhere along the housing 46 or at or near the near or far bit stabilizers 89, 90. Accordingly, in pack-off conditions, such sensors would detect an excessive pressure condition. In other examples, the pressure detector could be placed anywhere along the drill string or any tools having an anchorable exterior portion.

The pressure detector can be communicatively coupled to a control unit 380 on the drill or other processor or processor including control unit. The pressure detector transmits a signal representative of the pressure or excessive pressure condition to the control unit. Steps can then be taken to remediate the causal condition, including an automatic response by a control unit to take remedial action. For example, the control unit, upon receiving the signal from the pressure detector can then conduct any processing required to determine the pressure condition, whether the pressure exceeds a certain predetermined value, as well as determine what remedial steps to take. The control unit can then transmit commands to various tools or components of the drill string, including components to address the excessive pressure condition. This can include engagement of the drag release, and disengagement and radial retraction of drag members of the anti-rotation device or stabilizers. Further, the housing 46 can be rotated to dislodge the drilling device 20 and break up pack-off material. This is discussed in further detail in the following.

Figure 6:
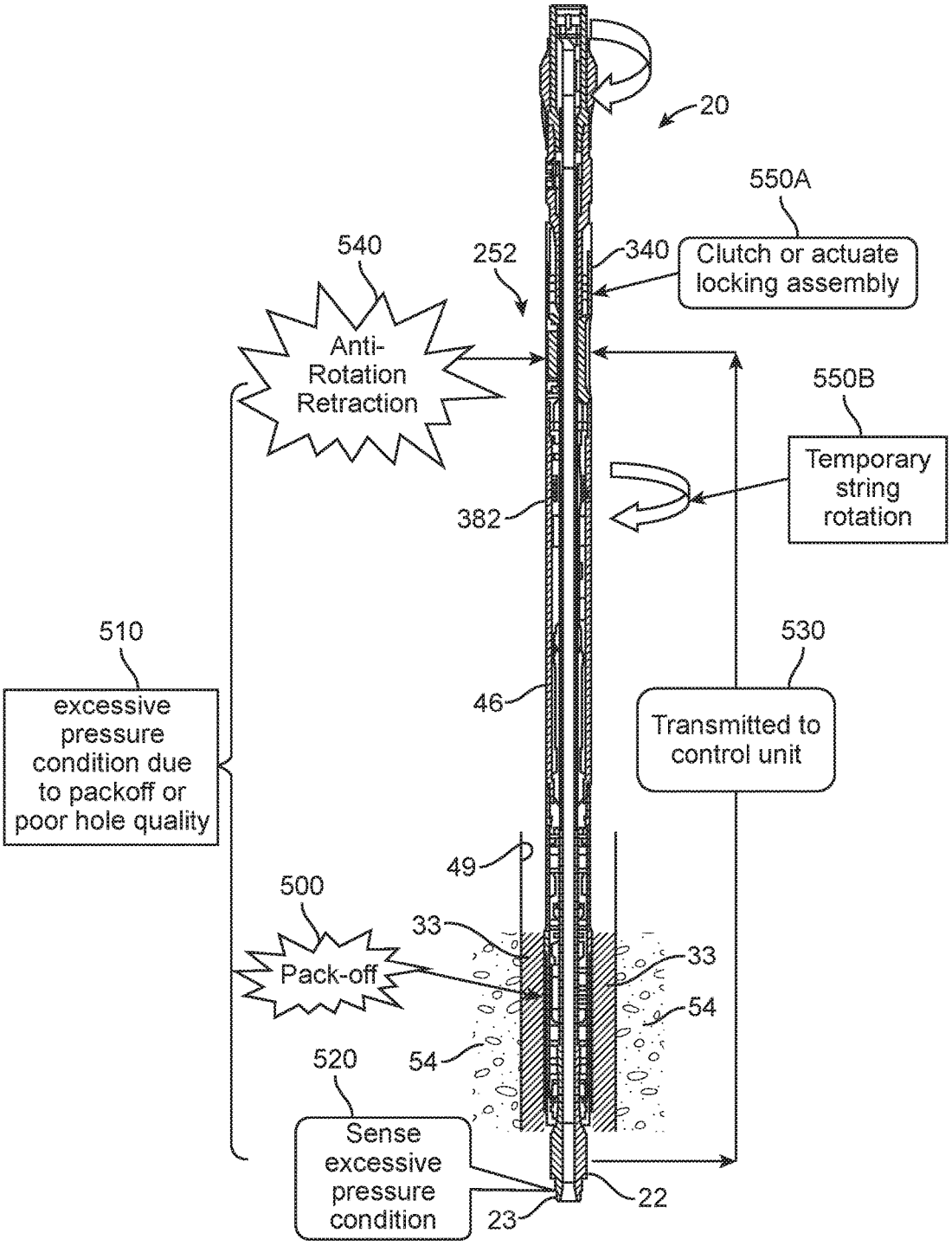
FIG. 6 is partial flow diagram illustrating one embodiment for detecting and remediating an excessive pressure condition according to the present disclosure.

Referring now to FIG. 6, there is illustrated a diagram and partial schematic of a detection of an excessive pressure condition along with drilling device 20 having drilling bit 22. As shown therein at 500 there is shown the occurrence of a pack-off against the housing 46 of the housing filling the annulus 33 with either cuttings from the drilling bit 22 or cave in from formation 54. Accordingly, an excessive pressure condition 510 occurs due to the pack-off. As shown in 520, the pressure detector senses the excessive pressure condition occurring in 510. Accordingly, in 530, the pressure detector transmits a signal representative of the pressure to a control unit, such as control unit 380. The control unit can be hydraulic, electrical or a logic controller, and can include a processor or itself simply be a processor, and is further described below with respect to FIG. 8.

After receiving the signal by the control unit, the control unit can process the signal to determine if a predetermined pressure value is met or exceeded. Further, the control unit can issue commands or transmit a new signal to other components in the drilling device 20 to remediate the excessive pressure condition. As shown in 540, the drag members 254 of the anti-rotation device 252 can be radially retracted and disengaged from the borehole wall 49. The drag members 254 can be retracted due to engagement or actuation of the drag release 277 for example. This can have an immediate impact by itself on reducing the excessive pressure condition. For example, by retracting drag members additional space is created in the annulus 33. Further, to the extent drag member contributed to formation of the pack-off, material could now flow past the anti-rotation device 252. Moreover, the housing 46 can be allowed to rotate upon disengaging the drag. Stabilizers may also be retracted and disengaged from the borehole wall 49.

Without the drag imposed by the deployment of drag members 254 from the anti-rotation device, the housing 46 may begin to rotate. This can depend on how "stuck" the housing 46 is within the pack-off. If the conditions are such that retracting the drag members does not result in dislodging the housing 46 or drilling device 20, additional remediating steps can be taken. For example, as shown in 550A, a clutch system 340 can be actuated to transmit rotational energy from the shaft or drill string to the housing 46. Additionally or alternatively, the locking assembly 382 can be actuated as in 550B to lock the housing 46 to the shaft 26 for rotation of the housing 46. The added torque from either the clutch system 340 or locking assembly 382 for rotating the housing 46 can provided additional energy for breaking up the pack-off and dislodging the housing 46. Both the clutch system 340 and locking assembly 382 can be communicatively coupled to the control unit 380.

The detection step can be conducted automatically, periodically, or the sensor can remain active as a safety for whenever pressure builds to an excessive value. The remediation steps can be conducted automatically upon sensing an excessive pressure value. For example, a control unit as soon as receiving a signal indicative of a predetermined pressure signal from the pressure detector can immediately conduct the remediation steps disclosed herein. Further, the steps such as anti-rotation disengagement in 540, and the rotation of the housing 46, as in 550A or 550B can be done automatically in succession. In other examples, the remediation steps 550A and 550B can be carried out upon determining that the retraction of drag members according to 540 did not result in a sufficient drop in pressure to below the excessive pressure condition value.

Additionally, the remediation steps can be conducted for a predetermined time period, or can be conducted continuously or periodically until the pressure sensed by the pressure detector reduces to below a particular value, such as the predetermined excessive pressure condition value.

Although most commonly the excessive pressure condition will be an increase in pressure, in some examples, the excessive pressure condition will be a sharp or marked drop in pressure. A decrease in pressure to such an extent as to be considered excessive can be a predetermined value, and can vary depending on the formation and conditions.

Method for Detection and Automated Remediation Utilizing a Control Unit

Figure 7:
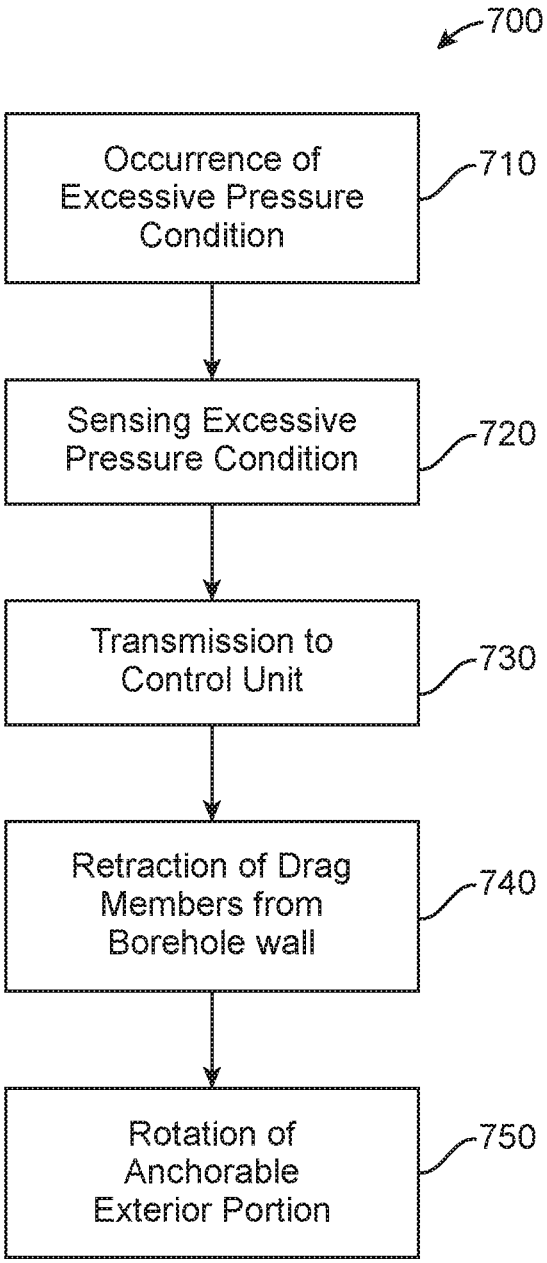
FIG. 7 is a flow diagram illustrating one method for detecting and remediating an excessive pressure condition in a borehole according to the present disclosure.

FIG. 7 illustrates an exemplary method 700 according to the present disclosure for detecting and remediating an excessive pressure condition. The method can be practiced by the systems disclosed herein or other appropriate system. As shown in 710, there can occur around anchorable exterior portion of a drill string the occurrence of an excessive pressure condition. This can be due to any number of reasons, such as the poor hole quality, blockage or entrapment of cuttings, cavings, or other materials blocking circulation or return of the drilling fluid (mud) uphole. Accordingly, an increase in pressure can result of such occurrence. The increase in pressure to an undesirable degree, or to a degree which signifies the presence of a pack-off, can be considered an excessive pressure condition. This value depends on the formation and condition, and can be a predetermined value. As shown in 720, an excessive pressure condition is sensed by a pressure detector. The pressure detector then transmits a signal to a control unit representative of the pressure or excessive pressure condition as shown in the 730. Upon receiving the signal, the control unit can then transmit or pass a signal to an anti-rotation device to engage or active the drag release and disengage the drag members from the borehole as shown in 740. The signal can additionally or alternatively be transmitted to stabilizers for retraction of any deployed drag members.

The effect of disengagement of drag members from the borehole wall can result in the natural rotation of the anchorable exterior portion, which can be for example the housing of the rotary steerable drilling device 20. This rotation itself can result in dislodge the anchorable exterior portion. If dislodged, this would allow the drilling fluid to again circulate, and result in a corresponding drop in pressure to a normal range. The anchorable exterior portion, or housing of the drilling device 20, can then also be rotated by a clutch system or a locking system as shown in 750, which transmits rotational energy from the shaft or drill string to the housing. This additional step of providing torque to the housing can be conducted automatically when an excessive pressure condition is sensed and drag members disengaged, or it can be conducted if the pressure does not reduce from the excessive pressure condition.

Control unit or units as disclosed herein have a processor and can be employed for making the calculations, determinations, and/or transmitting instructions herein. A control unit as disclosed herein can be associated with the anti-rotation device, or the rotary steerable drilling device, and can include any of the processors 12, 18, 44 or other processors associated with the drill string 32, control unit 380 of the rotary steerable drilling device. The control unit can be communicatively coupled to a pressure detector, and the anti-rotation device as well as stabilizers or other tools or portions of the drill string having an anchorable exterior portion for carrying out the systems and methods disclosed herein. The control unit or units implementing the processes according to the present disclosure can comprise hardware, firmware and/or software, and can take any of a variety of form factors. In particular, the control units described herein can include at least one processor optionally coupled directly or indirectly to memory elements through a system bus, as well as program code for executing and carrying out processes described herein.

The control units can be a processor or include a processor. A "processor" as used herein is an electronic circuit that can make determinations based upon inputs. In alternative examples, the circuit can be a hydraulic circuit. A processor can include a microprocessor, a microcontroller, and a central processing unit, among others. While a single processor can be used, the present disclosure can be implemented over a plurality of processors. For example, the plurality of processors can be associated with local control units of the rotary steerable drilling device, a global control units and/or the surface operator control unit, or a single control unit can be employed. Accordingly, for purposes of this disclosure, when referring to a control unit, it can include a local control unit or any other control unit or plurality of control units on the surface, in the drill string or rotary steerable drilling device.

Figure 8:
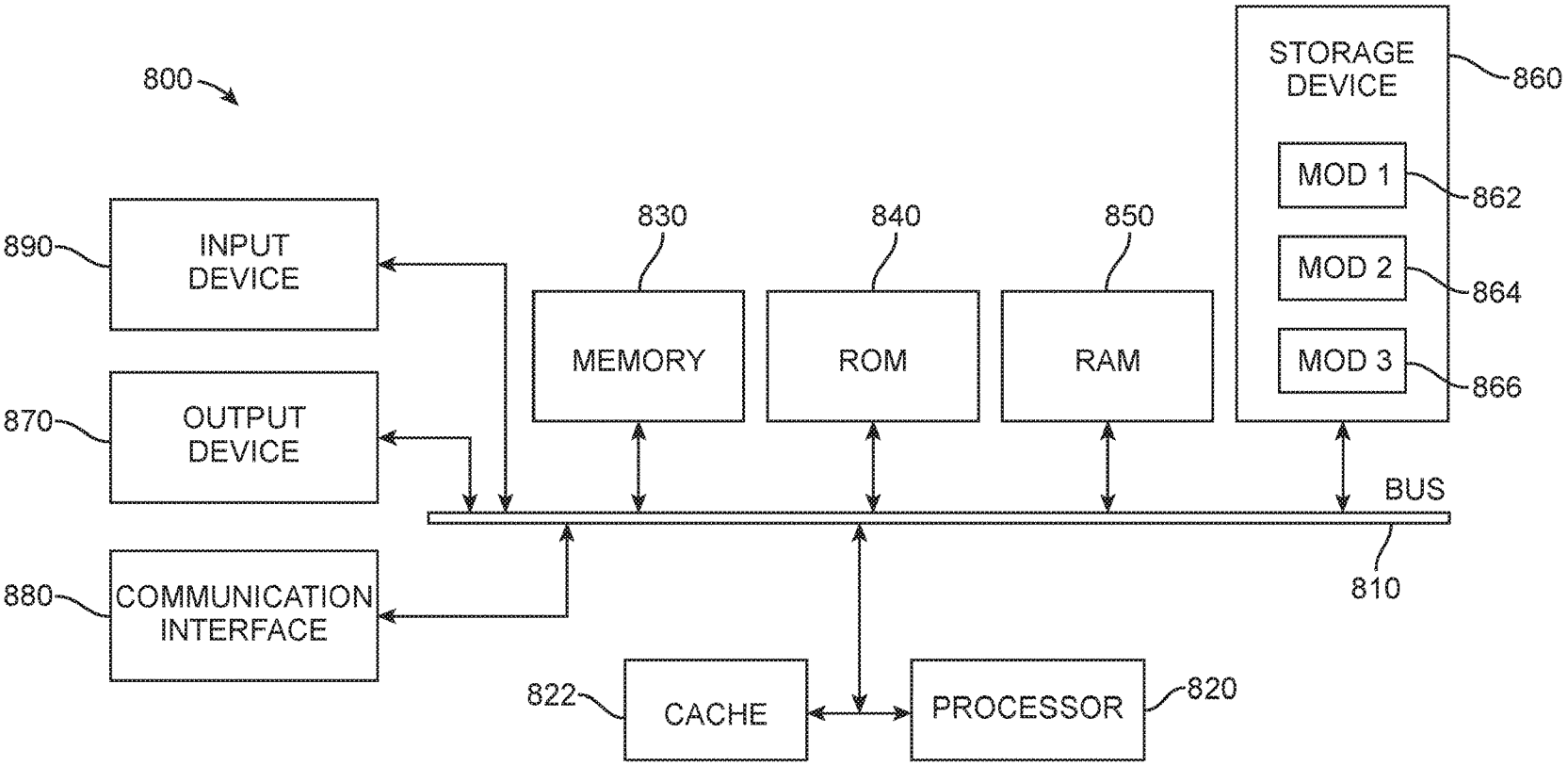
FIG. 8 is a schematic of an exemplary control unit for having a processor suitable for use in the methods and systems disclosed herein.

With reference to FIG. 8, an exemplary system and/or control unit 800 includes a processing unit (for example, a central processing unit (CPU) or processor) 820 and a system bus 810 that couples various system components, including the system memory 830 such as read only memory (ROM) 840 and random access memory (RAM) 850, to the processor 820. The system 800 can include a cache 822 of high-speed memory connected directly with, in close proximity to, or integrated as part of the processor 820. The system 800 can copy data from the memory 830 and/or the storage device 860 to the cache 822 for access by the processor 820. These and other modules can control or be configured to control the processor 820 to perform various operations or actions. The memory 830 can include multiple different types of memory with different performance characteristics.

Multiple processors or processor cores can share resources such as memory 830 or the cache 822, or can operate using independent resources. The processor 820 can include one or more of a state machine, an application specific integrated circuit (ASIC), or a programmable gate array (PGA) including a field PGA. The system bus 810 can be any of several types of bus structures including a memory bus or memory controller, a peripheral bus, and a local bus using any of a variety of bus architectures. A basic input/output (BIOS) stored in ROM 840 or the like, may provide the basic routine that helps to transfer information between elements within the computing device 800, such as during start-up.

The computing device 800 can further include storage devices 260 or computer-readable storage media such as a hard disk drive, a magnetic disk drive, an optical disk drive, tape drive, solid-state drive, RAM drive, removable storage devices, a redundant array of inexpensive disks (RAID), hybrid storage device, or the like. The storage device 860 can include software modules 862, 864, 866 for controlling the processor 820. The system 800 can include other hardware or software modules. Although the exemplary embodiment(s) described herein employs the hard disk as storage device 860, other types of computer-readable storage devices which can store data that are accessible by a computer, such as magnetic cassettes, flash memory cards, digital versatile disks (DVDs), cartridges, random access memories (RAMs) 850, read only memory (ROM) 840, a cable containing a bit stream and the like may also be used in the exemplary operating environment. Tangible computer-readable storage media, computer-readable storage devices, or computer-readable memory devices, expressly exclude media such as transitory waves, energy, carrier signals, electromagnetic waves, and signals per se.

The basic components and appropriate variations can be modified depending on the type of device, such as whether the device 800 is a small, handheld computing device, a desktop computer, or a computer server. When the processor 820 executes instructions to perform "operations", the processor 820 can perform the operations directly and/or facilitate, direct, or cooperate with another device or component to perform the operations.

To enable user interaction with the computing device 800, an input device 890 represents any number of input mechanisms, such as a microphone for speech, a touch-sensitive screen for gesture or graphical input, keyboard, mouse, motion input, speech and so forth. An output device 870 can also be one or more of a number of output mechanisms known to those of skill in the art. In some instances, multimodal systems enable a user to provide multiple types of input to communicate with the computing device 800. The communications interface 880 generally governs and manages the user input and system output. There is no restriction on operating on any particular hardware arrangement and therefore the basic hardware depicted may easily be substituted for improved hardware or firmware arrangements as they are developed.

One or more parts of the example computing device 800, up to and including the entire computing device 800, can be virtualized. For example, a virtual processor can be a software object that executes according to a particular instruction set, even when a physical processor of the same type as the virtual processor is unavailable.

Numerous examples are provided herein to enhance understanding of the present disclosure. A specific set of examples are provided as follows. In a first example a rotary drilling system is disclosed including a drag member extendable for selectively engaging a borehole wall, and a drag release communicatively coupled to a pressure detector and coupled to the drag member for automatically disengaging the drag member in response to an excessive downhole pressure condition sensed by the pressure detector.

In a second example, there is disclosed herein the rotary drilling system according to the first example, further including a housing incorporable as a portion of a drill string and having an anchorable exterior portion; and the drag member coupled to the anchorable exterior portion of the housing and retractable from a deployed position in which the drag member engages a borehole wall and resists rotation of the housing.

In a third example, there is disclosed herein the rotary drilling system according to the first or second examples, wherein the drag member is radially retractable relative to the housing.

In a fourth example, there is disclosed herein the rotary drilling system according to any of the preceding examples first to the third, wherein the drag member is radially retractable toward the housing and the pressure detector is located below the housing.

In a fifth example, there is disclosed herein the rotary drilling system according to any of the preceding examples first to the fourth, further including a drill string including a drill bit at a distal end of the drill string.

In a sixth example, there is disclosed herein the rotary drilling system according to any of the preceding examples first to the fifth, further including the pressure detector coupled to the drill string and located above the drill bit for sensing an over-pressure condition occurring above the drill bit and below the housing.

In a seventh example, there is disclosed herein the rotary drilling system according to any of the preceding examples first to the sixth, wherein the drill string further includes a rotary steerable drilling device capable of establishing a deflection angle and azimuthal toolface direction of the drill bit.

In an eighth example, there is disclosed herein the rotary drilling system according to any of the preceding examples first to the seventh, further including an anti-rotation device positioned at an exterior of the housing and comprising the radially retractable drag member that is deployable across an annulus formed between the housing and the borehole between an extended and retracted configuration of the drag member.

In a ninth example, there is disclosed herein the rotary drilling system according to any of the preceding examples first to the eighth, further including a drilling shaft rotatably supported in the housing and which urges rotation of the housing within the borehole when the drag member is in the retracted configuration.

In a tenth example, there is disclosed herein the rotary drilling system according to any of the preceding examples first to the ninth, wherein the drag member is one of a plurality of drag members, each of which has a wheel-shape and is oriented to roll parallel to a longitudinal centerline of the housing.

In an eleventh example, there is disclosed herein the rotary drilling system according to any of the preceding examples first to the tenth, further including a drilling shaft deflection assembly contained within the housing and comprising an outer eccentric ring and an inner eccentric ring that engages the drilling shaft.

In a twelfth example, there is disclosed herein the rotary drilling system according to any of the preceding examples first to the eleventh, further including a variable friction clutch operatively coupled between the drilling shaft and the housing that increases rotation of the housing as the amount of friction is increased between the drilling shaft and the housing by the variable friction clutch.

In a thirteenth example, there is disclosed herein the rotary drilling system according to any of the preceding examples first to the twelfth, further including a drilling mud supply that circulates drilling mud from the drill bit upward through the annulus carrying drill cuttings therewith and the pressure detector is exposed to the drilling mud and senses a pressure condition thereof.

In a fourteenth example, there is disclosed herein the rotary drilling system according to any of the preceding examples first to the thirteenth, wherein the excessive downhole pressure condition is an over-pressure condition in the drilling mud indicative of a pack-off condition existing about the housing.

In a fifteenth example, there is disclosed herein the rotary drilling system according to the fourteenth example, wherein the over-pressure condition is characterized by a detected rate of pressure change that exceeds a predetermined value.

In a sixteenth example, there is disclosed herein the rotary drilling system according to any of the preceding examples fourteenth to the fifteenth, wherein the over-pressure condition is characterized by a detected magnitude of pressure change that exceeds a predetermined value.

In a seventeenth example, there is disclosed herein the rotary drilling system according to any of the preceding examples first to the sixteenth, further including a releasable lock operatively coupled between the drilling shaft and the housing that is engaged when the drag release is engaged.

In an eighteenth example, there is disclosed herein a method for detecting an excessive downhole pressure condition and automatically remediating the causal condition of the detected excessive pressure condition with a rotary drilling system, the method including receiving a signal representative of a sensed excessive downhole pressure condition that exceeds a predetermined value; and automatically disengaging an anti-rotation device and thereby permitting rotation of the anti-rotation device within the borehole.

In a nineteenth example, there is disclosed herein the method according to the eighteenth example, further including engaging a variable friction clutch operatively coupled between a drilling shaft and a housing carrying the anti-rotation device for increasing rotation of the housing as the amount of friction is increased between the drilling shaft and the housing.

In a twentieth example, there is disclosed herein the method according to the eighteenth or nineteenth examples, further including monitoring, with a pressure detector, a drilling mud circulation from a drill bit upward through a wellbore annulus formed about a drill string and carrying drill cuttings, the pressure detector exposed to the drilling mud and sensing a pressure condition thereof.

In a twenty first example, there is disclosed herein the method according to any of the preceding examples eighteenth to the twentieth, further including sensing an over-pressure condition in the drilling mud indicative of a drill cuttings pack-off condition existing about the housing.

The embodiments shown and described above are only examples. Many details are often found in the art such as the other features of a rotary steerable drilling systems, and particularly anti-rotation devices used in such systems. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A rotary drilling system, comprising: a drag member radially extendable for selectively engaging a borehole wall, and a drag release communicatively coupled to a pressure detector and coupled to the drag member, the drag release automatically disengaging the drag member in response to an excessive downhole pressure condition sensed by the pressure detector.

2. The rotary drilling system of claim 1, further comprising:

a housing incorporable as a portion of a drill string and having an anchorable exterior portion; and the drag member coupled to the anchorable exterior portion of the housing and retractable from a deployed position in which the drag member engages a borehole wall and resists rotation of the housing.

3. The rotary drilling system of claim 2, wherein the drag member is radially retractable relative to the housing.

4. The rotary drilling system of claim 2, wherein the drag member is radially retractable toward the housing and the pressure detector is located below the housing.

5. The rotary drilling system of claim 4, further comprising a drill string including a drill bit at a distal end of the drill string.

6. The rotary drilling system of claim 5, further comprising:

the pressure detector coupled to the drill string and located above the drill bit for sensing an over-pressure condition occurring above the drill bit and below the housing.

7. The rotary drilling system of claim 6, wherein the drill string further comprises a rotary steerable drilling device capable of establishing a deflection angle and azimuthal toolface direction of the drill bit.

8. The rotary drilling system of claim 5, further comprising:

an anti-rotation device positioned at an exterior of the housing and comprising the radially retractable drag member that is deployable across an annulus formed between the housing and the borehole between an extended and retracted configuration of the drag member.

9. The rotary drilling system of claim 8, further comprising:

a drilling shaft rotatably supported in the housing and which urges rotation of the housing within the borehole when the drag member is in the retracted configuration.

10. The rotary drilling system of claim 9, wherein the drag member is one of a plurality of drag members, each of which has a wheel-shape and is oriented to roll parallel to a longitudinal centerline of the housing.

11. The rotary drilling system of claim 10, further comprising:

a drilling shaft deflection assembly contained within the housing and comprising an outer eccentric ring and an inner eccentric ring that engages the drilling shaft.

12. The rotary drilling system of claim 9, further comprising:

a variable friction clutch operatively coupled between the drilling shaft and the housing that increases rotation of the housing as the amount of friction is increased between the drilling shaft and the housing by the variable friction clutch.

13. The rotary drilling system of claim 9, further comprising:

a releasable lock operatively coupled between the drilling shaft and the housing that is engaged when the drag release is engaged.

14. The rotary drilling system of claim 8, further comprising:

a drilling mud supply that circulates drilling mud from the drill bit upward through the annulus carrying drill cuttings therewith and the pressure detector is exposed to the drilling mud and senses a pressure condition thereof.

15. The rotary drilling system of claim 14, wherein the excessive downhole pressure condition is an over-pressure condition in the drilling mud indicative of a pack-off condition existing about the housing.

16. The rotary drilling system of claim 15, wherein the over-pressure condition is characterized by a detected rate of pressure change that exceeds a predetermined value.

17. The rotary drilling system of claim 15, wherein the over-pressure condition is characterized by a detected magnitude of pressure change that exceeds a predetermined value.

18. A method for detecting an excessive downhole pressure condition within a borehole and automatically remediating a causal condition of the detected excessive pressure condition with a rotary drilling system, the method comprising:

receiving a signal representative of a sensed excessive downhole pressure condition that exceeds a predetermined value; and automatically disengaging an anti-rotation device and thereby permitting rotation of the anti-rotation device within the borehole.

19. The method of claim 18, further comprising:

engaging a variable friction clutch operatively coupled between a drilling shaft and a housing carrying the anti-rotation device for increasing rotation of the housing as the amount of friction is increased between the drilling shaft and the housing.

20. The method of claim 18, further comprising:

monitoring, with a pressure detector, a drilling mud circulation from a drill bit upward through a wellbore annulus formed about a drill string and carrying drill cuttings, the pressure detector exposed to the drilling mud and sensing a pressure condition thereof.

21. The method of claim 20, further comprising:

sensing an over-pressure condition in the drilling mud indicative of a drill cuttings pack-off condition existing about the housing.

* * * * *